US006260495B1

(12) United States Patent
Stewart et al.

(10) Patent No.: US 6,260,495 B1
(45) Date of Patent: Jul. 17, 2001

(54) HEM MONITORING SYSTEM

(75) Inventors: Parks C. Stewart; Robert A. Trobaugh, III, both of Duluth, GA (US)

(73) Assignee: Phoenix Automation, Norcross, GA (US)

( * ) Notice: Subject to any disclaimer, the term of this patent is extended or adjusted under 35 U.S.C. 154(b) by 0 days.

(21) Appl. No.: 09/098,889

(22) Filed: Jun. 17, 1998

(51) Int. Cl.[7] ..... D05B 19/00; D05B 35/02

(52) U.S. Cl. ..... 112/470.05; 112/141; 112/475.02; 112/475.06

(58) Field of Search ..... 112/470.05, 470.01, 112/141, 142, 143, 270, 275, 277, 278, 117, 103, 475.02, 475.03, 475.04, 475.06

(56) References Cited

U.S. PATENT DOCUMENTS

| | | | | |
|---|---|---|---|---|
| 3,884,166 | * | 5/1975 | Rinehimer et al. | 112/141 X |
| 4,574,719 | | 3/1986 | Balke | 112/272 |
| 4,696,246 | | 9/1987 | Rohr et al. | 112/272 |
| 4,726,501 | | 2/1988 | Wiley | 226/15 |
| 4,798,152 | * | 1/1989 | Simons et al. | 112/278 X |
| 4,967,676 | | 11/1990 | Hagino et al. | 112/272 |
| 5,103,749 | | 4/1992 | Geisselmann et al. | 112/262.3 |
| 5,159,874 | | 11/1992 | Adamski et al. | 112/262.3 |
| 5,205,232 | | 4/1993 | Sadeh et al. | 112/262.3 |
| 5,259,329 | | 11/1993 | Reedman et al. | 112/121.12 |
| 5,537,946 | * | 7/1996 | Sadeh et al. | 112/475.03 |
| 5,572,940 | * | 11/1996 | Burton et al. | 112/470.16 |

OTHER PUBLICATIONS

TH78CA 13/TH78CA14 8/12 Bin Linear Cameras by Thomson–CSF, Specification, pp. 1–7, dated Dec. 5, 1997.

* cited by examiner

*Primary Examiner*—Peter Nerbun
(74) *Attorney, Agent, or Firm*—Sutherland Asbill & Brennan LLP

(57) ABSTRACT

A hem monitoring system for a textile finishing device having one or more sewing heads positioned along a predetermined path for finishing the hem on a textile product in a high speed manner. The monitoring system includes a camera, a monitor, and means for controlling the camera such that an image of the hem is captured and displayed on the monitor so as to inspect the quality of the hem.

34 Claims, 5 Drawing Sheets

HEM MONITORING SYSTEM

TECHNICAL FIELD

The present invention relates to a textile product finishing apparatus and more particularly relates to a hem monitoring device for use with high-speed textile finishing equipment.

BACKGROUND OF THE INVENTION

Traditional textile products, such as bedding sheets and the like, are generally "finished" to produce a quality product. By the term "finished" or "finishing," we mean that the edges of the sheet are hemmed in a uniform manner. The edges of the sheet are cut, folded, and sewn. The "finishing" is performed either by hand or in an automated process.

Presently, most sheet and other types of textile manufacturing is performed in an automated process due to speed and efficiency. In such an automated process, the quality of the hem is monitored by a worker as the sheet advances through the various cutting and sewing devices. The sheet generally is sewn with the hem "up" to enable the worker to monitor the quality of the hem. By "up," we mean that the fold and the stitching is visible. A quality hem will have a uniform fold. The stitching will be a uniform distance from the edge of the sheet, will not have any gaps, and will not cause the sheet material to "bunch" together. Most problems with the quality of the hem occur at the beginning and ending corners of the sheet where the respective edges meet.

Modern textile finishing equipment not only hems the sides of the sheet, but also folds and packages the sheet in a high speed operation. The sheet may move through the equipment at speeds of about 800 inches per minute or more. For appearance reasons, however, the sheets are now run through the hemming operations with the hem in the "down" position. After the hemming operations, the sheet often goes directly into the folding apparatus without an opportunity for a worker to inspect the quality of the hem. Because of the speed in which the equipment operates and because the sheet is advanced through the device with the hem down, there is little opportunity for the worker to inspect the quality of the hem. Manufacturers have attempted to solve this inspection problem by positioning workers literally underneath the machine to inspect periodically the hem. This approach is inefficient in that the worker does not have enough time to inspect properly the hem. Further, this position can be awkward or even dangerous for the worker.

What is needed, therefore, is a means to monitor and inspect the quality of the hemming process in a high-speed textile finishing apparatus. These monitoring and inspection means must enable the worker to maintain quality control over the product without placing the worker in a physically awkward or dangerous position.

SUMMARY OF THE INVENTION

The present invention provides a hem monitoring system for a textile finishing device having one or more sewing heads positioned along a predetermined path for finishing the hem on a textile product in a high speed manner. The monitoring system includes a camera, a monitor, and means for controlling the camera such that an image of the hem is captured and displayed on the monitor so as to allow inspection of the quality of the hem.

Specific embodiments include the use of one or more detectors positioned along the predetermined path for detecting the presence of a corner of the textile product as it advances. The means for controlling the camera includes a personal computer with a frame grabber card for capturing an image from the camera. The frame grabber card captures an image of the corner of the sheet from the camera based upon the position of the corner as detected by the detector. The camera is preferably a digital video camera. Alternatively, a strobe may be used to freeze the image of the textile product as it advances. The detectors are preferably photoelectric eyes.

The finishing apparatus as a whole includes means for advancing the textile product along the predetermined path in a high speed manner, means for hemming the edges of the textile product, and means for inspecting the quality of the hems as described above. The means for advancing the textile product includes an unwind stand assembly, a cutting device, a dancer assembly, and a feed pull assembly. The means for hemming the edges of the textile product includes one or more hem assemblies with one or more sewing heads, fold elements, roller arms, and cutting heads. One hem assembly is positioned on a first side of the predetermined path and a second one is positioned on a second side of the predetermined path. One of the hem assemblies is mounted on a gantry for movement in a direction perpendicular to the predetermined path so as to accommodate differently sized sheets. An on/off switch is positioned adjacent to the monitor such that the worker can stop the apparatus to remove an improperly hemmed sheet. Alternatively, the sheet can be flagged for later removal.

The method for inspecting the hem of the present invention includes the steps of advancing the textile product along a predetermined path, folding an edge of the textile product, sewing the edge to form the hem, detecting the position of the textile product along the predetermined path, capturing an image of the hem based upon the detected position, and displaying the image of the hem. The hem is advanced in the down position. The advance of the textile product may be stopped based upon the image of the hem.

Thus, it is an object of the present invention to provide a visual inspection device.

It is a further object of the present invention to provide a visual inspection device for use with a hemming apparatus.

It is a still further object of the present invention to provide a visual inspection device that can capture images of a sheet hem in a high speed hemming apparatus.

It is a still further object of the present invention to provide a visual inspection device that can capture and hold images of the corners of a sheet to inspect hem quality.

Other objectives, features, and advantages of the present invention will become apparent upon reading the following specification, when taken in connection with the drawings and the claims.

DETAILED DESCRIPTION OF THE INVENTION

Figure 1:
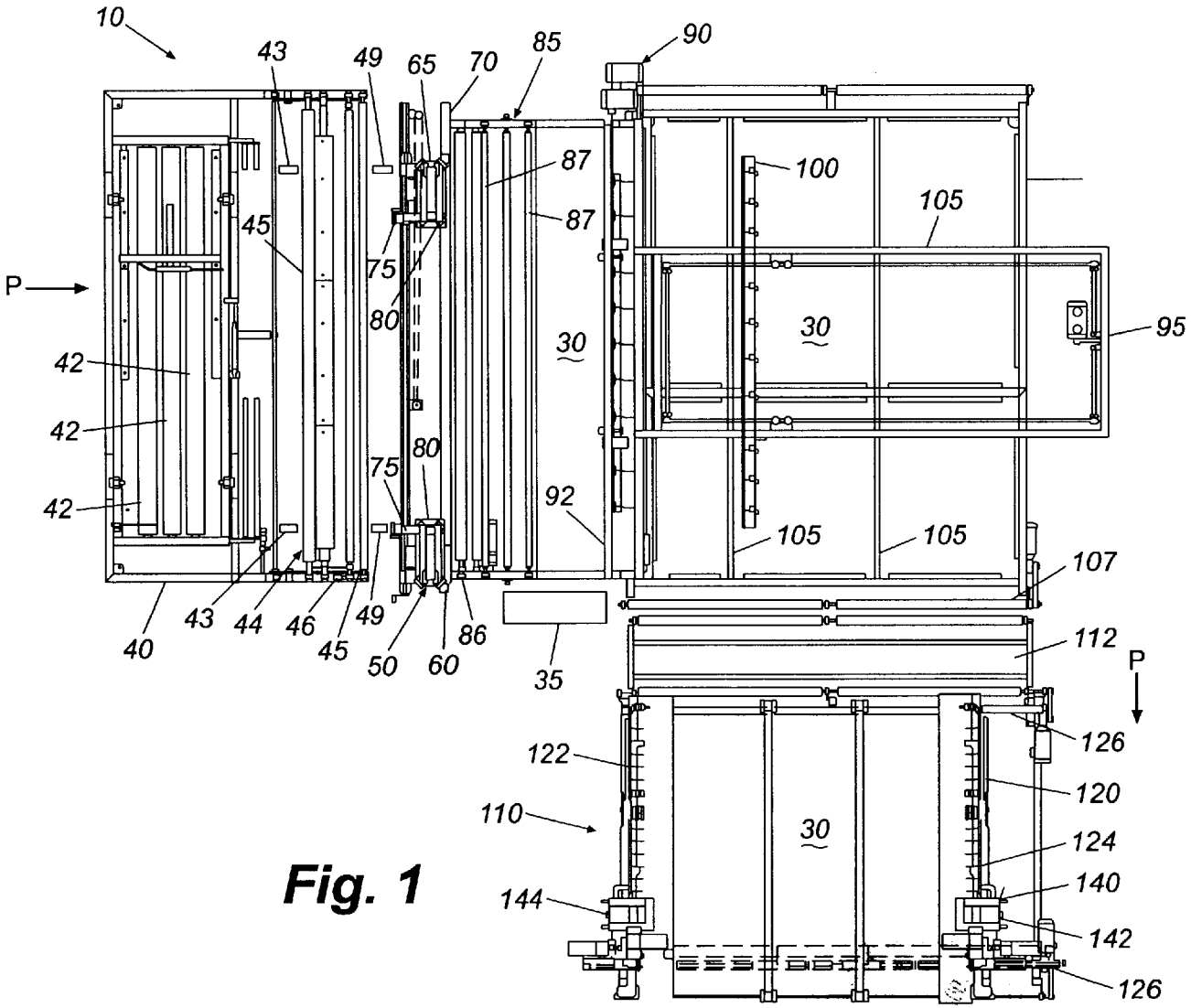
FIG. 1 is a top view of the hemming apparatus of the present invention.
Figure 2:
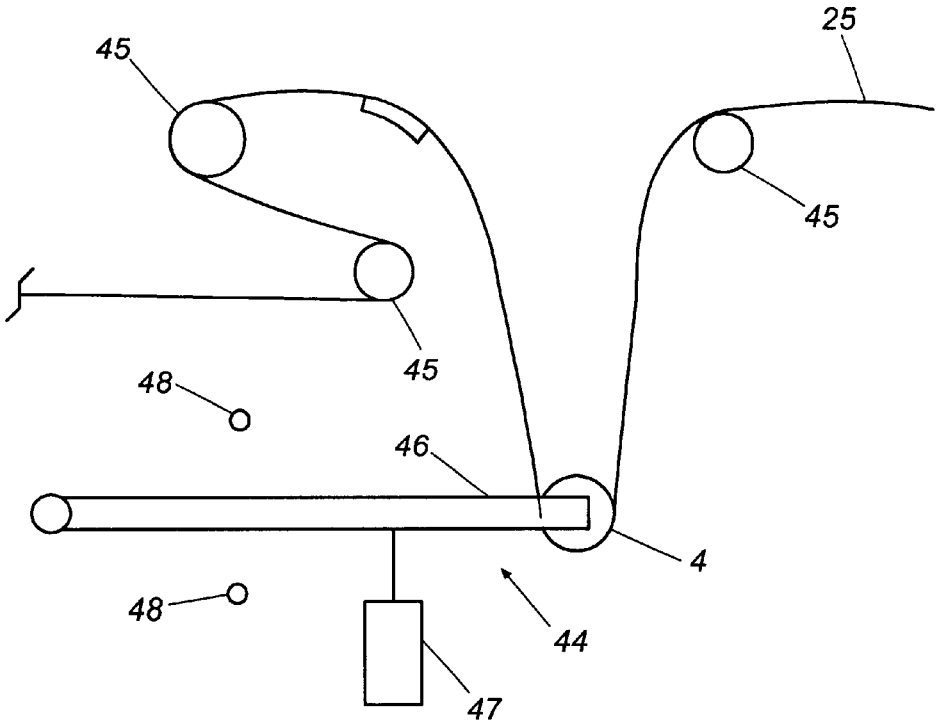
FIG. 2 is a side view of the dancer system of the present invention.
Figure 4:
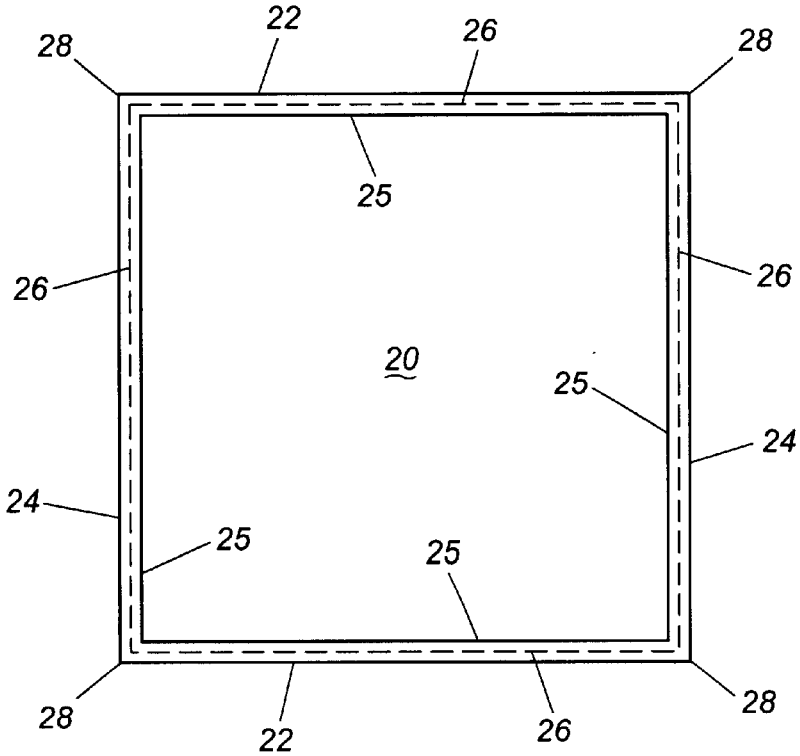
FIG. 4 is a plan view of a sheet manufactured by the present invention with the size of the fold and the hem exaggerated.
Figure 3:
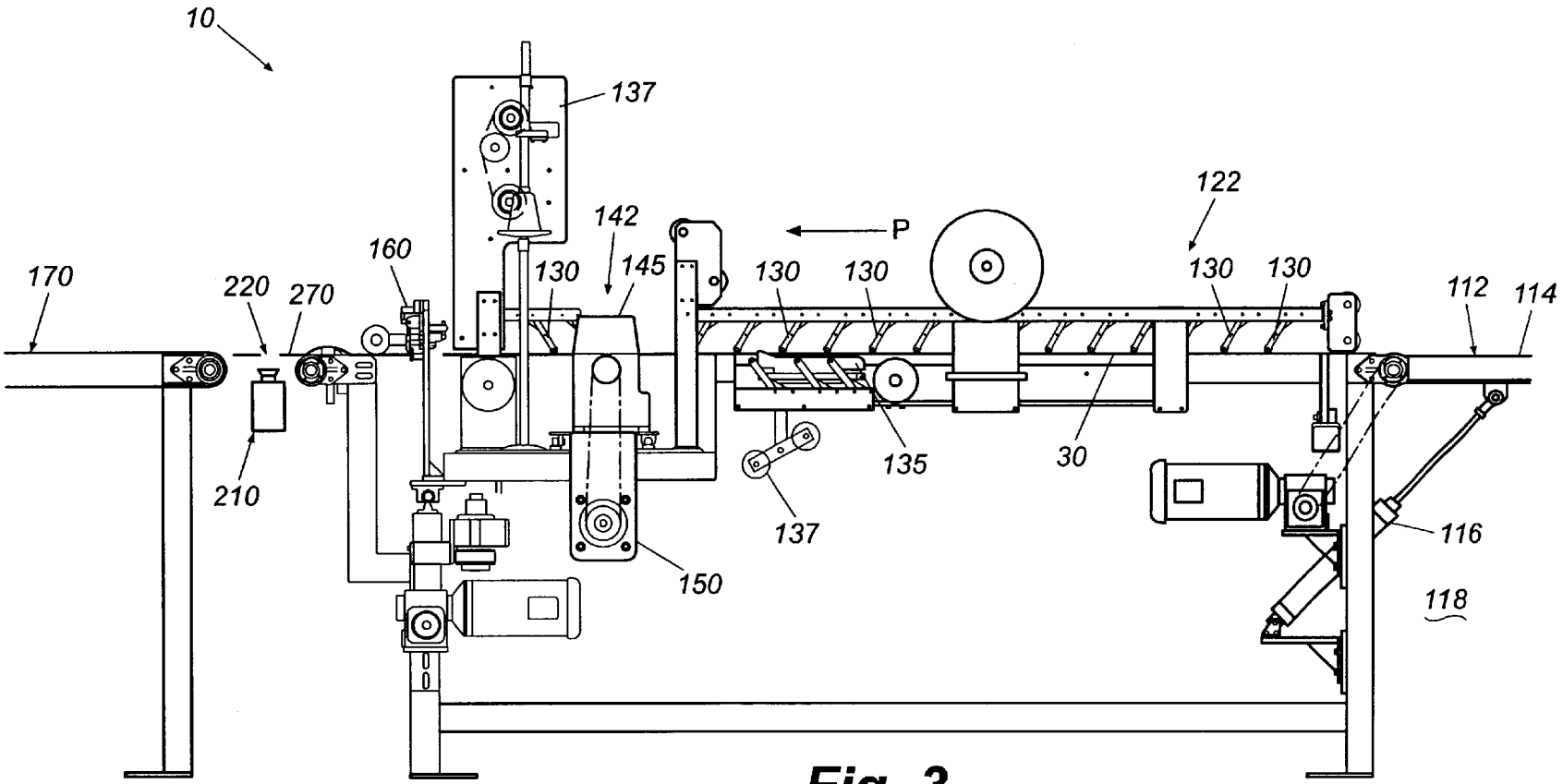
FIG. 3 is a side view of the hemming apparatus of the present invention showing the camera of the visual inspection system.

Referring now to the drawings, in which like numerals represent like parts throughout the several views, FIGS. 1–3 show a hemming apparatus 10. The hemming apparatus 10 cuts and hems a sheet 20 from a continuous strip 25 of sheet material. The hemming apparatus 10 is known in the industry as "flat sheet"-type machine, in that the sheet 20 remains flat as it advances through the apparatus 10. The sheet 20 may be made from cotton, a blended cotton/synthetic material, or other types of textile materials. A typical sheet 20 is shown in FIG. 4. The sheet 20 includes two lateral sides 22, two transverse sides 24, a fold 25 on each side 22, 24, a hem 26 on each side 22, 24, and four corners 28. The size of the folds 25 and the hems 26 are exaggerated in FIG. 4 to show their respective positions with respect to the sheet 20 as a whole.

The hemming apparatus 10 operates in an assembly-line fashion along a predetermined path P. The predetermined path P advances adjacent to and along a tabletop 30. Operation of the various components of the apparatus 10 is set, monitored and controlled by a personal computer 35, a programmable controller, or other type of conventional control means. The personal computer 35 is preferably a conventional IBM-compatible computer with a microprocessor such as the Pentium® microprocessor sold by Intel Corporation of Santa Clara, Calif.

The hemming apparatus 10 may include an unwind stand assembly 40 positioned along the predetermined path P. As is shown in FIGS. 1 and 2, the unwind stand assembly 40 includes one or more rollers 42, one or more selvage blades 43, and a dancer system 44. The rollers 42 are conventional spool-type roller or similar designs suitable for mounting the continuous strip 25 of sheet material. The selvage blade 43 is a conventional cutting blade that trims the edges of the continuous strip 25 to a uniform size. One selvage blade 43 is positioned on either side of the predetermined path P. The selvage blades 43 are powered by conventional means. The dancer system 44 include a plurality of rollers 45 each attached to a dancer arm 46. The dancer arms 46 are each operated by an air cylinder 47 or other type of conventional device. The vertical advance of the dancer arms 46, and hence the amount of material pulled off of the rollers 45 is monitored by a plurality of proximity switches 48. The proximity switches 48 are positioned on either side of each dancer arm 46 and are of conventional design. The dancer system 44 unwinds the continuous strip 25 of sheet material off of the rollers 45 and onto the tabletop 30 under continuous tension. After the continuous strip 25 advances from the dancer system 44, the edges of the strip 25 are folded over a given length by a fold formation 49. The fold formation 49 is a rigid bar over which the continuous strip 25 runs to fold over the edges of the strip 25.

Adjacent to the unwind stand assembly 40 is a first sew station 50. The first sew station 50 is positioned along the predetermined path P. The first sew station 50 includes a stationary sewing assembly 60 and a moveable sewing assembly 65 positioned on opposite sides of the predetermined path P. The movable sewing assembly 65 is mounted on a gantry 70 for movement in the direction perpendicular to the predetermined path P. The movable sewing assembly 65 is capable of adapting to differently sized sheets 20, i.e., the movable sewing assembly 65 moves to match the position of the lateral side 22 of the sheet 20.

The sewing assemblies 60, 65 trim and sew the lateral edges 22 of the continuous strip 25 of sheet material as the continuous strip 25 advances along the predetermined path P. The sewing assemblies 60, 65 each include a cutting wheel 75 and a sewing head 80. The cutting wheel 75 is preferably a round-type cutting wheel with a speed sufficient to match the advance of the continuous strip 25. Similarly, the sewing head 80 is preferably a chain stitch or overedge-type sewing head capable of speeds of approximately 8000 RPM, such as the Pegasus brand sewing head sold by Pegasus Corporation of Norcross, Ga.

The continuous strip 25 of sheet material is pulled off of the unwind stand assembly 40 and through the first sew station 50 by a second dancer assembly 85 positioned along the predetermined path P. The second dancer assembly 85 includes a plurality of dancer arms 86 and rollers 88 to draw the continuous strip 25 of sheet material through the first sew station 50 under tension to ensure a consistent feed rate. The second dancer assembly 85 is similar in design to the dancer system 44 of the unwind feed assembly 40. Up to 10 feet of the continuous strip 25 of sheet material can be drawn into the second dancer assembly 85 at one time.

Adjacent to the second dancer apparatus 85 is a cutter device 90. The cutter device 90 cuts an individual sheet 20 from the continuous strip 25 of sheet material along one of the transverse edges 24 of the sheet 20. The cutter device 90 is mounted on a gantry 92 along the predetermined path P in the direction perpendicular to the predetermined path P. Alternatively, the cutter device 90 could be mounted within a slot (not shown) within the tabletop 30. The cutter device 90 is a high speed cutting blade capable of speeds of about 3600 RPM, such as the Wolf brand cutting blade sold by Cutting & Sewing Room Equipment Company of Atlanta, Ga.

Positioned next to the cutter device 90 on the tabletop 30 along the predetermined path P is a feed pull assembly 95. The feed pull assembly 95 includes one or more feed pull grippers 100 or gripping arms mounted onto a gantry 105. The gantry 105 moves in the direction of the predetermined path P. The feed pull grippers 100 grab the first transverse edge 24 of the continuous strip 25 of sheet material as it emerges from the dancer assembly 85. The feed pull grippers 100 and the gantry 105 pull the strip 25 flat on the tabletop 30 such that the cutter device 90 can cut the second transverse edge 24 to form the sheet 20. The feed pull grippers 100 and the gantry 105 are powered by a servo motor 105.

Figure 5:
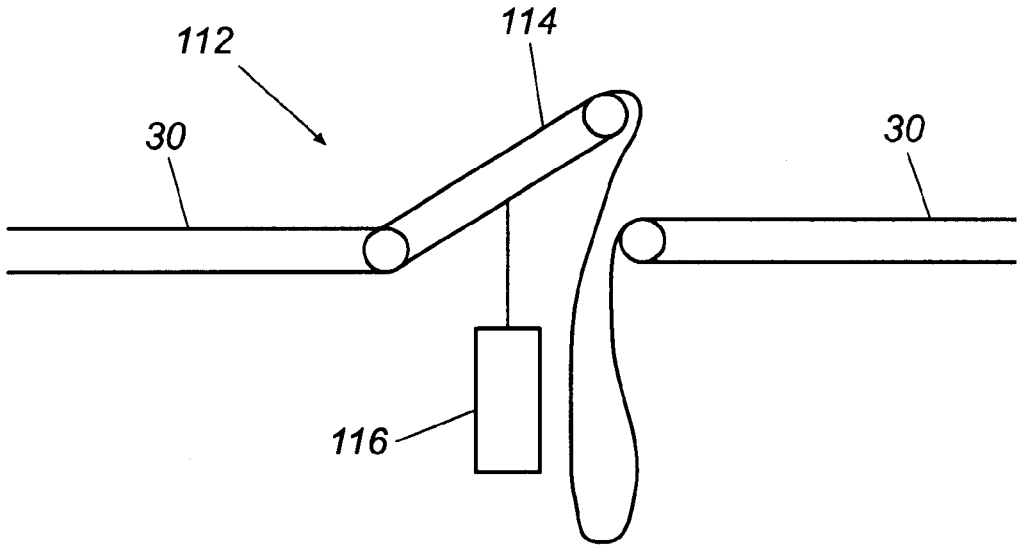
FIG. 5 is a side view of the trap door system of the present invention.

Once the sheet 20 has been advanced by the feed pull grippers 100 and cut by the cutter 90, the predetermined path P turns in a perpendicular direction to finish the transverse edges 24 of the sheet 20. The sheet 20 is released by the feed pull grippers 100 and advanced along the predetermined path P with one of the lateral edges 22 of the sheet 20 leading. The sheet 20 is advanced along the tabletop 30 by a plurality of belts 105 and a plurality of rollers 107 into a second sew assembly 110. Alternatively, the sheet 20 may first travel into a trap door assembly 112. As is shown in FIG. 5, trap door assembly 112 is positioned on the predetermined path P along the tabletop 30. The trap door assembly 112 includes a trap door 114 operated by a hydraulic/pneumatic cylinder 116. The cylinder 116 raises the trap door 114 such that the sheet 20 is advanced into a lower holding area 118 positioned underneath the tabletop 30 and back out again. The trap door assembly 112 feeds the sheet 20 into the second sew assembly 110 in a controlled manner.

As is shown in FIG. 3, the second sew-cutter assembly 110 includes two hem assemblies 120, a movable hem assembly 122 and a stationary hem assembly 124. The hem assemblies 122, 124 are positioned on opposite sides of the predetermined path P along the tabletop 30. The movable hem assembly 122 is mounted on one or more rails 126 to accommodate differently sized sheets 20 in a manner similar to the moveable sewing assembly 65. The sheet 20 advances through the second sew-cutter assembly 110 at a speed of about one foot per second.

Each hem assembly 122, 124 includes a plurality of roller arms 130 and a primary fold element 135. Because the hem assemblies 122, 124 are identical, only hem assembly 122 will be described in detail. The rollers arms 130 keep the transverse edge 24 of the sheet 20 in line while the primary fold element 135 forces the edge 24 of the sheet 20 to fold over onto itself to form the fold 25. The fold 25 is then kept in place by the further roller arms 130. The roller arms 130 are powered by one or more drive mechanisms 137.

The second sew-cutter assembly 110 also includes two sew assemblies 140, movable sew assembly 142 and stationary sew assembly 144. The sew assemblies 142, 144 are positioned on opposite sides of the predetermined path P along the tabletop 30. The movable sew assembly 142 is mounted with the movable hem assembly 122 on the one or more rails 126 to accommodate differently sized sheets 20.

After the fold 25 is created in the hem assemblies 122, 124, the sheet 20 advances into the sewing assemblies 142, 144. Because the sew assemblies 142, 144 are identical, only sew assembly 142 will be described in detail. The sewing assembly 142 includes a sewing head 145 powered by a sewing motor 150. The sewing head 145 sews along the fold 25 to create the hem 26. The sewing motor 150 is generally a 1.5 horsepower electrical motor. A Pegasus brand sewing head or similar type sewing head may be employed as is described above with respect to sewing head 80. Further, more than one type of sewing head 145 may be employed to give the apparatus 10 versatility in accommodating various types of sheets 20 or other types of textile materials.

After the sheet 20 is hemmed, the thread used by the sewing head 145 may be clipped by a clipper device 160. The clipper device includes a conventional barber shear-type cutting blade or a similar device. The sheet 20 is advanced onto an exit conveyor 170 for folding, wrapping, and shipping operations (not shown).

Figure 6:
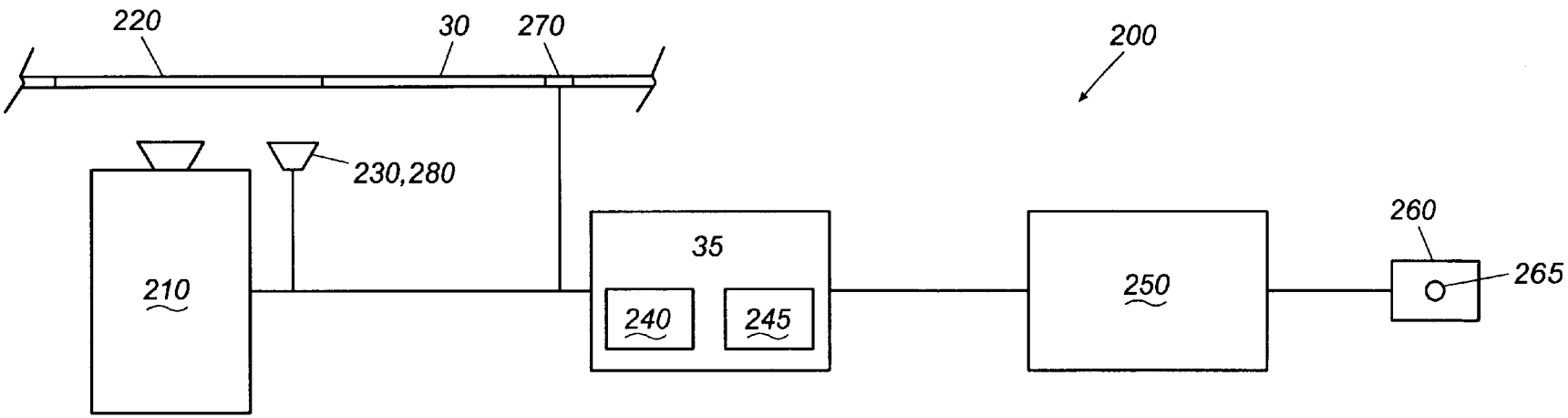
FIG. 6. is a schematic view of the components of the visual inspection system.

FIG. 6 shows a schematic view of the components of a hem inspection system 200. The hem inspection system 200 includes one or more cameras 210 positioned adjacent to the tabletop 30 to monitor the hem 26 of the sheet 20 as it passes along the predetermined path P. The cameras 210 preferably are positioned just under the tabletop 30 between the second sew-cutter assembly 110 and the exit conveyor 160. This portion of the tabletop 30 includes a window 220. The window 220 can be made of glass, clear plastic, or other types of transparent materials such that the camera 210 can see therethrough. One camera 210 is positioned on each side of the predetermined path P to view the hem 26 on both transverse edges 24 of the sheet 20. Located adjacent to each camera 210 is a light source 230. The light source 230 is a halogen-type lamp or other type of conventional light. The light source 230 illuminates the hem 26 as it advances along the predetermined path P across the window 220. The light source 230 may be optional depending upon the nature of the camera 210 and the operating conditions of the apparatus 10 as a whole.

The camera 210 preferably is a high speed digital camera such as the digital 8/10 bit linear camera sold under the designation TH78CA13ACC by Thompson TCF of France. This camera 210 has a data rate of up to approximately 40 MHz, an image format of approximately 1024 active pixels, and a line rate of approximately 33,000 lines per second. The camera 210 has approximately a six (6) inch wide field of view. Alternatively, a conventional Peripheral Component Interconnect ("PCI") based digital camera 210 may be used. An analog camera 210 or other types of video optical devices also may be used.

Operation of the cameras 210 is controlled by the personal computer 35. The digital input from the cameras 210 is processed in the personal computer 35 by a frame grabber card 240. The frame grabber card 240 includes imaging boards and software and is the interface between the cameras 210 and the personal computer 35. A preferred frame grabber card 240 includes that sold by Dipix Imaging Products of Ontario, Canada under the designation LPG-132 Power Grabber™. The frame grabber card 240 has a data rate of up to about 32 Mbytes/Sec. The frame grabber card 240 also can accommodate analog input. The personal computer 35 also may include a data storage device 245, such as a conventional disk or tape drive, to store the images captured by the frame grabber card 240.

The visual output of the frame grabber card 240 and the personal computer 35 is shown on a monitor 250. The monitor 250 may be any type of conventional video monitor with a resolution of at least about 640×480 pixels. Adjacent to the monitor 250 is a control box 260. The control box 260 operates the apparatus 10 and includes at least an on/off switch 265 to halt operation of the assembly 10.

Operation of the camera 210 and the frame grabber card 240 may be triggered by one or more detectors 270. The detectors 270 may be conventional photoelectric eyes or other types of conventional mechanical or electrical sensors. At least one detector 270 is positioned on the tabletop 30 on each side of the predetermined path P between the camera 210 and the second sew-cutter assembly 110. When the sheet 20 advances along the predetermined path P, the corners 28 of the sheet 20 cover or uncover the detectors 270. The change of state determined by the detectors 270 informs the personal computer 35 that the corner 28 of the sheet 20 is approaching, such that the frame grabber card 240 is timed to capture that image of the corner 28 from the camera 210 and display that image on the monitor 250 for a given amount of time. Alternatively, the camera 210 could be triggered by an internal feature of the camera 210 itself.

As an alternative to the frame grabber card 240, the present invention also may employ a strobe light 280 that is either timed or triggered by the detectors 270 to capture an image of the corners 28 of the sheet 20. The strobe device 280 may be a conventional strobe light timed to freeze momentarily the image of a moving object. The strobe 280 may be used with a continuous video image shown on the monitor 250. Other types of conventional image processing systems also may be used herein.

In use, the continuous strip 25 of sheet material is drawn off of the unwind stand assembly 40 by the dancer assembly 85. The continuous strip 25 is pulled along the predetermined path P. The dancer assembly 85 pulls the continuous strip 25 through the first sew station 50 so as to cut, and perhaps fold and hem the lateral edges 22 of the continuous strip 25. The dancer assembly 85 pulls the continuous strip 25 through the first sew station 50 at a constant rate of advance. The feed pull gripper assembly 95 then pulls the continuous strip 25 out of the dancer assembly 85 and along the predetermined path P until the sheet 20 lays flat on the tabletop 30. The cutter device 90 then cuts the sheet 20 from the continuous strip 25 along a transverse edge 24.

The sheet 20 is then advanced into the second sew-cutter assembly 110 to finish the transverse edges 24 of the sheet 20. The transverse edges 24 are folded in the hem assembly 120 by the plurality of roller arms 130 and the primary fold element 135 to form the fold 25. The fold 25 is then sewn in the sew assemblies 140 to create the hem 26.

As the sheet 20 advances through the sew assemblies 140, the lead corner 28 of the sheet 20 triggers the detectors 270. The sheet 20 then advances along the tabletop 30 over the window 220. The camera 210 continually scans the hem 26 of the sheet 20, particularly at the area of the corners 28, as the sheet 20 advances. The detector 270 tells the frame grabber card 240 within the personal computer 35 to "grab" or capture the image of the corner 28. The personal computer 35 then displays the image of the corner 28 on the monitor 250. The image is held for approximately two to three seconds while the worker visually inspects the quality of the hem 26. A split screen may be used on the monitor 250 to allow the worker to inspect both corners 28 at one time. As the sheet 20 continues along the tabletop 30, the trailing corner at 28 passes over the detectors 270. This change of state also informs the frame grabber card 240 to "grab" that view of the corner 28 as it passes across the window 220. If the light source 230 is needed, the hem 26 is continually illuminated by the light source 230 as the hem 26 passes over the window 220. The camera 210 also may scan the sheet 20 as a whole to check for other defects such as holes, spots, print quality, weave defects, or other imperfections that may impact the quality of the sheet 20.

Figure 7:
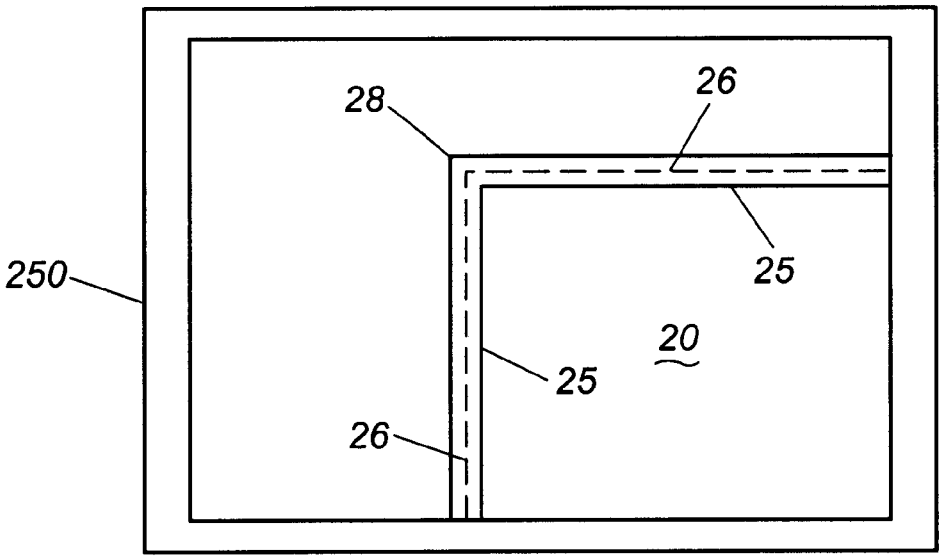
FIG. 7 is a pictorial view of a monitor of the present invention showing the hem in a corner of a sheet.

FIG. 7 shows a monitor 250 with an image of a sheet 20, particularly a corner 28 such that the worker may inspect the quality of the hem 26. In the event the worker sees a hem 26 that is defective in any manner, the worker can hit the on/off switch 265 on the control box 260. The worker may then remove the defective sheet 20 from the assembly 10. Alternatively, the switch 265 may divert the sheet 20 to a different exit point along the apparatus 10 so as to segregate the defective sheets 20 from the approved sheets 20 or otherwise tag this sheet 20 as being defective. Also alternatively, visual inspection software may be used with the personal computer 35 such that any image of a hem 26 that does not fall within predefined parameters will automatically stop the apparatus 10 or at least flag that particular sheet 20 for later inspection or removal. The captured images of the hems 26 may be maintained by the personal computer 35 or transferred to the storage device 245 for long-term storage. The images may be maintained for quality control or inventory purposes.

Although the finishing apparatus 10 has been described herein in great detail, any type of conventional finishing apparatus 10 may be used with the hem inspection system 200 of the present invention. For example, a high speed finishing device is sold by Texpa-Arbter of Germany. The hem inspection system 200 herein may be incorporated into such a device or any other type of conventional, high speed textile finishing device where hem quality is essential.

From the foregoing description of the preferred embodiment and the several alternatives, other alternative constructions of the present invention may suggest themselves to those skilled in the art. The scope of the present invention, therefore, is to be limited only by the claims below and equivalents thereof.

We claim:

1. A hem monitoring system for a textile finishing device, said textile finishing device having one or more sewing heads positioned along a predetermined path for finishing a hem on a textile product in a high-speed advancement manner, said monitoring system comprising:

a camera adapted to be positioned along said predetermined path;

a monitor adapted to be positioned adjacent to said device; and means for controlling said camera such that an image of said hem is captured during said high-speed advancement manner and displayed on said monitor so as to allow the inspection of the quality of said hem, said means for controlling said camera comprising a personal computer and a frame grabber card.

2. The hem monitoring system of claim 1, wherein said means for controlling said camera comprises one or more detectors positioned along said predetermined path.

3. The hem monitoring system of claim 2, wherein said one or more detectors comprise photoelectric eyes.

4. The hem monitoring system of claim 1, wherein said camera comprises a digital video camera.

5. A hem monitoring system for a textile finishing device, said textile finishing device having one or more sewing heads positioned along a predetermined path for finishing a hem on a textile product in a high-speed advancement manner, said monitoring system comprising:

a camera adapted to be positioned along said predetermined path;

a monitor adapted to be positioned adjacent to said device; and a personal computer with a frame grabber card for controlling said camera such that an image of said hem is captured during said high-speed advancement manner and displayed on said monitor so as to allow the inspection of the quality of said hem.

6. The hem monitoring system of claim 5, further comprising one or more detectors adapted to be positioned along said predetermined path for detecting the presence of a corner of said textile product along said predetermined path.

7. An apparatus for finishing a textile product, comprising:

means for advancing said textile product along a predetermined path in a high-speed manner;

means for hemming the edges of said textile product disposed along said predetermined path; and camera means for enabling the inspection of the quality of the hems on said textile product disposed along said predetermined path.

8. The apparatus for finishing a textile product of claim 7, wherein said means for advancing said textile product comprises an unwind stand assembly for loading a continuous strip of a plurality of said textile products and advancing said continuous strip along said predetermined path.

9. The apparatus for finishing a textile product of claim 8, further comprising means for cutting said textile product from said continuous strip positioned along said predetermined path.

10. The apparatus for finishing a textile product of claim 7, wherein said means for advancing said textile product comprises a dancer assembly positioned along said predetermined path.

11. The apparatus for finishing a textile product of claim 7, wherein said means for advancing said textile product comprises a feed pull assembly positioned along said predetermined path.

12. The apparatus for finishing a textile product of claim 7, wherein said means for hemming the edges of said textile product comprises one or more hem assemblies.

13. The apparatus for finishing a textile product of claim 12, wherein said hem assemblies comprise one or more sewing heads.

14. The apparatus for finishing a textile product of claim 12, wherein said hem assemblies comprise one or more fold elements.

15. The apparatus for finishing a textile product of claim 12, wherein said hem assemblies comprise one or more roller arms.

16. The apparatus for finishing a textile product of claim 12, wherein said hem assemblies comprise one or more cutting heads.

17. The apparatus for finishing a textile product of claim 12, wherein a first one of said one or more hem assemblies is positioned on a first side of said predetermined path.

18. The apparatus for finishing a textile product of claim 17, wherein a second one of said one or more hem assemblies is positioned on a second side of said predetermined path.

19. The apparatus for finishing a textile product of claim 17, wherein said first one of said one or more hem assemblies comprises a rail positioned in a direction perpendicular to said predetermined path for movement of said hem assembly thereon.

20. The apparatus for finishing a textile product of claim 7, wherein said camera means for enabling the inspection of the quality of the hems on said textile product comprises a camera positioned underneath said predetermined path.

21. The apparatus for finishing a textile product of claim 20, wherein said camera means for enabling the inspection of the quality of the hems on said textile product comprises a monitor positioned adjacent to said apparatus.

22. The apparatus for finishing a textile product of claim 21, wherein said camera means for enabling the inspection of the quality of the hems on said textile product comprises means for controlling said camera such that an image of said hem is captured and displayed on said monitor so as to enable the inspection of the quality of said hem.

23. The apparatus for finishing a textile product of claim 22, wherein said means for controlling said camera comprises a personal computer.

24. The apparatus for finishing a textile product of claim 23, wherein said means for controlling said camera comprises a frame grabber card.

25. The apparatus for finishing a textile product of claim 22, wherein said means for controlling said camera comprises one or more detectors positioned along said predetermined path.

26. The apparatus for finishing a textile product of claim 25, wherein said detectors comprise photoelectric eyes.

27. The apparatus for finishing a textile product of claim 21, further comprising an on/off switch positioned adjacent to said monitor.

28. A method for inspecting the hem on a textile product, comprising the steps of:

detecting the position of said textile product along a predetermined path;

capturing an image of said hem on said textile product based upon the detected position of said textile product along said predetermined path; and displaying said image of said hem.

29. The method of claim 28, further comprising the step of advancing said textile product along said predetermined path with said hem in a down position.

30. The method of claim 29, further comprising the step of stopping the advance of said textile product along said predetermined path based upon the image of said hem.

31. The method of claim 28, wherein said displaying step comprises processing said image.

32. A method of finishing the hem on a textile product, comprising the steps of:

advancing said textile product along a predetermined path;

folding an edge of said textile product;

sewing said edge of said textile product to form said hem;

detecting the position of said textile product as it advances along said predetermined path; and and inspecting said hem via a camera system based upon the detected position of said textile product along said predetermined path.

33. A method for the inspection of hem quality for a textile product in a high speed textile finishing apparatus having one or more sewing heads positioned adjacent to a predetermined path, comprising the steps of:

advancing said textile product through said one or more sewing heads to produce a hem;

triggering an optical device to capture an image of said hem as it advances along said predetermined path; and inspecting said image of said hem.

34. The method of claim 33, further comprising the step of stopping said apparatus if said hem is not properly finished.

* * * * *